United States Patent [19]

Whitley

[11] 4,198,613

[45] Apr. 15, 1980

[54] FILTER CONTACT

[75] Inventor: Thomas J. Whitley, Scarborough, Canada

[73] Assignee: Bunker Ramo Corporation, Oak Brook, Ill.

[21] Appl. No.: 906,730

[22] Filed: May 17, 1978

[51] Int. Cl.[2] ..... H01H 7/14

[52] U.S. Cl. ..... 333/181; 333/185; 333/206

[58] Field of Search ..... 333/17 L, 167, 181, 333/185, 206; 339/6R, 278 T; 361/111, 118, 119, 126, 54

[56] References Cited

U.S. PATENT DOCUMENTS

| | | | |
|---|---|---|---|
| 2,841,508 | 7/1958 | Roup et al. | 117/200 |
| 2,983,855 | 5/1961 | Schlicke | 317/242 |
| 3,243,738 | 3/1966 | Schlicke et al. | 333/79 |
| 3,268,744 | 8/1966 | Kaiser et al. | 307/93 |
| 3,329,911 | 7/1967 | Schlicke et al. | 333/79 |
| 3,496,433 | 2/1970 | Siegrist | 317/258 |
| 3,579,155 | 5/1971 | Tuchto | 333/70 |
| 3,582,862 | 6/1971 | Anderson | 339/14 |
| 3,666,505 | 5/1972 | Hoffman et al. | 106/39 R |
| 3,842,374 | 10/1974 | Schlicke | 333/79 |

*Primary Examiner*—Alfred E. Smith
*Assistant Examiner*—Robert E. Wise
*Attorney, Agent, or Firm*—F. M. Arbuckle; W. Lohff

[57] ABSTRACT

A pin or socket type electrical contact of an efficient modular design selectively provides transient voltage overload protection, inductive and capacitive filter impedance for frequency discrimination, and series DC resistance and a fusing element for appropriate current limiting functions. In all forms, the filter contact may include resilient, electrically conductive bushings interposed between the aforesaid impedance components and the input and output ends of the contact both to accommodate simplified and reliable assembly of the modular components and to assure a negligible probability of mechanical stress damage in installation of the contact in its system operating environment.

20 Claims, 8 Drawing Figures

FILTER CONTACT

BACKGROUND OF THE INVENTION

The present invention relates generally to new and improved electrical filter contacts of a type providing protection from broad spectrum electromagnetic interference (EMI) including electromagnetic pulses (EMP). More particularly, the invention is directed to an energy level and frequency discriminating electrical filter contact of a modularized design for selectively providing transient voltage and current overload protection and a filtering of undesired frequency components. The filter contact may be of a miniaturized configuration and is in any event constructed to afford a substantially mechanically stress-free interconnection in the electrical system operating environment.

It has become a common and preferred practice in recent years to incorporate within electrical connectors components for affording a filtering of EMI signals falling outside of a desired signal frequency range or exceeding a given power level, i.e., voltage and current amplitude. The prior art has also contemplated incorporation of current limiting protection in a connector through the provision of suitable DC resistance as well as protection against unwanted voltage transients by use of known electrical breakdown devices. For example, U.S. Pat. No. 3,842,374—Schlicke illustrates several forms of an electrical feedthrough connector providing capacitive filtering of unwanted high frequency interference and surge voltage protection by use of a metal oxide varistor (MOV) which exhibits a low resistance-bypass characteristic in the presence of electrical signals exceeding a predetermined peak voltage value.

U.S. Pat. No. 3,579,155—Tuchto, assigned to the same assignee as the present invention, discloses a filter pin connector including inductive and capacitive reactance components concentrically disposed about a central conductive rod in an appropriate fashion to provide a preselected filtering characteristic. The aforesaid Tuchto patent also discloses the use of flexible conductive bushings or grommets for enabling stress-free interconnection of the contact and the filtering components disposed along the central portion of the contact.

While the prior art and most notably the above described Tuchto patent displays certain advantageous features, none of the prior art provides a full range of EMI protection. Moreover, the prior art does not disclose a contact design that is peculiarly suited for incorporation of selected ones or all of the EMI protection features into a single filter contact by a modularized building block design that facilitates efficient and economical manufacture of such contacts.

SUMMARY OF THE INVENTION

It is therefore a primary aspect of the present invention to provide a new and improved electrical filter contact affording total EMI protection.

Another aspect of the present invention is to provide an improved electrical filter contact that conveniently permits selective incorporation of a full range of EMI protection components in any preselected relation by means of an efficient and economical modular building block process thereby enabling an efficient and customized manufacture from a minimum inventory of components.

Another aspect of the present invention is to provide an electrical filter contact incorporating in addition to the aforesaid features a provision for a substantially stress-free mechanical and electrical interconnection of the individual contact components and a reliable, stress-free interfitting of the electrical contact assembly with the electrical system thereby to substantially obviate possible damage to certain fragile components of the contact structure.

Accordingly, the invention is generally directed in one of its broader aspects to an electrical contact comprising conductor means having input and output portions for connection to respective electrical signal carrying elements and having a central portion comprising an electrical circuit path between the input and output portions. Electrical surge protection means is disposed along the central portion and includes a ground electrode disposed in spaced relation to the central conductor means. A suitable varistor material is disposed intermediate the central portion and the ground electrode for shunting to ground transient voltage surges in excess of a predetermined amplitude. Resilient conductive means including a first flexible, grommet member is interposed between one end of the surge protection means and the first end portion of the conductor means for effecting a low resistance electrical path and a flexible mechanical connection therebetween. Other aspects of the invention are defined in detail in the accompanying claims and description of the preferred embodiments.

BRIEF DESCRIPTION OF THE DRAWINGS

The novel features of the present invention are set forth with particularity in the appended claims. The invention together with further objects and advantages thereof may best be understood, however, by reference to the following description taken in conjunction with the accompanying drawings in the several figures of which like reference numerals identify like elements and in which:

FIG. 1*a* is a schematic diagram of an electrical circuit equivalent of the pin or socket contact of FIG. 1;

FIG. 2*a* is a schematic illustration of the electrical circuit equivalent of the contact of FIG. 2;

FIG. 3*a* is a schematic diagram of the electrical circuit equivalent of the embodiment of FIG. 3;

FIG. 4*a* is a schematic diagram of the electrical circuit equivalent of the contact of FIG. 4.

DESCRIPTION OF THE PREFERRED EMBODIMENTS

Figure 1:
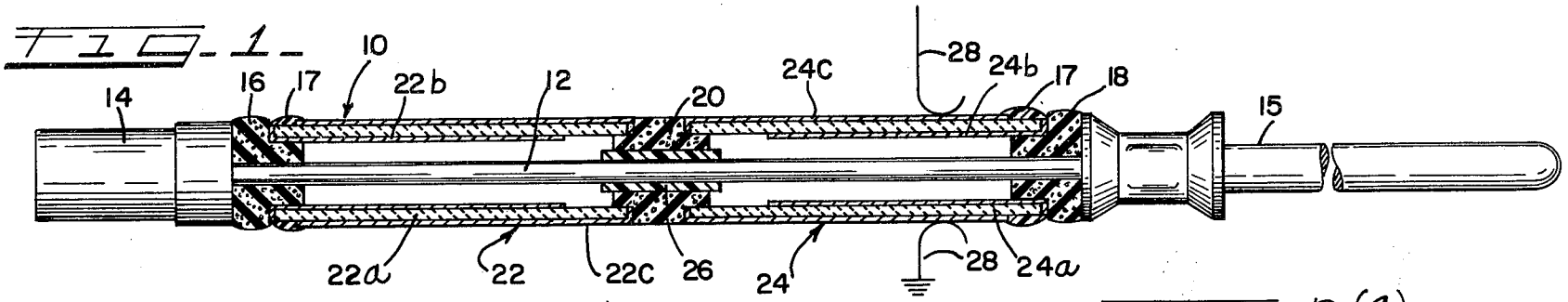
FIG. 1 is a view in longitudinal section of a first preferred embodiment of the invention providing low pass filter and surge voltage protection to its associated electrical system components (not shown)

Referring initially to FIG. 1, there is illustrated the first of several illustrative embodiments of the electrical filter contact of the present invention. It will be recognized by those skilled in the art that the alternative arrangements depicted by the several embodiments illustrated are representative of but a few of the different combinations and permutations of EMI protection features that may be achieved by use of the modularized, building block concept that is one feature of the present invention.

Specifically, the electrical contact pin or sockets 10 comprises a generally conventional conductor means composed of an elongated metallic rod 12 having secured to its opposite ends, integrally, or as by crimping, a rear wire terminating means 14 and a metallic pin 15 (or alternatively a socket end) for mating purposes, which respectively define the input and output portions of the conductor means. Herein, for convenience, the contact end portions 14 and 15 are referred to as an input and output portion, respectively, although it is to be understood that current flow may proceed in either direction through the illustrated contacts.

In the embodiment of FIG. 1, the spaced contact end portions 14, 15, are connected through the central rod 12 in a continuous electrical circuit path that provides a minimum electrical impedance to signals within a desired frequency range appearing at the input 14 and conducted along the metal rod 12 to the output pin 15. As will be seen, the length of the central rod portion 12 is selected to appropriately accommodate the selected number and type of EMI protection components. Except for alternative forms of the invention wherein non-conductive components are interposed in the axial path between the rod 12 and the input and output elements 14, 15, the construction of the electrical conductor means 12, 14 and 15 remains the same for each of the embodiments and therefore will not again be described in detail, although the same numerals will for convenience be used to identify like components in the description of the succeeding embodiments.

It is preferred in accordance with the present invention to provide resilient conductive means at the opposed ends of the central rod portion 12 in respective juxtaposition, to the contact end portion 14 and the forward end portion 15. In the present embodiment, this objective is obtained by provision of flexible conductive grommets or bushings 16, 18 that effect a low resistance electrical connection with the input and output ends 14, 15 of the contact through either a compressive engagement or, alternatively, by the elements 14 and 15 being formed in part over and crimped into secure engagement with the conductive grommets 16, 18. A central grommet 20 disposed intermediate the two EMI components presently to be described may be of a generally similar construction to that of the conductive grommets 16, 18 so as to effect a secure electrical connection with the EMI components by mechanical compression. The structure and method of making electrical filter contact elements embodying flexible conductive rubber grommets at the contact end portions is disclosed and claimed in the aforesaid Tuchto patent and therefore will not be described in further detail herein.

The electrical filter contact 10 of FIG. 1 is further composed of what shall be designated herein as an overload protection means and a circuit means, identified generally in the drawing by the respective reference numerals 22 and 24. The overload protection means as more fully described hereinafter provides protection of the contact and system components from spurious voltages exceeding a predetermined level, for example, 100 volts. The circuit means as exemplified in the several embodiments to be described provides a preselected frequency discrimination characteristic through appropriate combinations of types and values of reactive impedances for filtering unwanted signal frequencies or noise; in addition, the circuit means may provide a current limiting function.

The surge protection and circuit means 22, 24 are disposed in tandem between the contact end portions 14, 15 and are both of the generally tubular or sleeve-like construction shown so as to freely fit over the central rod 12. In accordance with one feature of the invention, each of the means disposed between the contact ends 14, 15 and generally along the central rod portion 12, is separated by a conductive rubber grommet or bushing 16, 18, 20. The individual electrical components are maintained, as will be seen, in intimate electrical contact and secure mechanical engagement by selecting the relative spacing of the contact end portions 14, 15 so as to effect a resilient compression of the conductive grommets or bushings 16, 18, 20.

The overload protection means 22 is disposed in tandem to the circuit means 24 and is physically separated from the input 14 and circuit means 24 by the respective conductive grommets 16, 20 which maintain, however, electrical continuity between the means 22, 24. Overload protection means 22 is composed preferably of a cylindrical sleeve of a metal oxide varistor material *22a* to which there is applied on the internal and external surfaces, respectively, a pair of conductive electrode elements *22b* and *22c*. These electrodes may be formed by deposition of any of several known conductive materials as silver or copper, onto the internal and external surfaces of the metal oxide sleeve *22a* thereby to form concentric cylindrical coatings on sleeve *22a*. In the present embodiment, it is preferred that the respective cylindrical electrodes *22b* and *22c* coatings integrally continue from the cylindrical sleeve *22a* onto respective opposite end faces of the sleeve *22a*. In this regard, the electrode *22b* is extended onto the lefthand or forward-most face of the sleeve *22a* while the electrode *22c* extends onto the right-hand or rearward-most face of the sleeve *22c*. In order to avoid significant leakage between the electrodes *22b* and *22c*, the portions of the electrodes *22b* and *22c* adjacent the end faces of the sleeve *22a* are separated by a distance at least equal to the thickness of the sleeve *22a*, and preferably by a multiple of such distance. The surface regions of the sleeve *22a* which separate the electrode coatings *22b* and *22c* are preferably coated with a dielectric material 17, such as epoxy enamel, to inhibit surface corona and voltage breakdown between the electrodes *22b* and *22c* along the surface of the sleeve *22a*.

The metal oxide sleeve *22a* may be composed of basically a zinc oxide with added minor amounts of other oxides, such as beryllium oxide, busmuth oxide, lanthanum oxide, yttrium oxide, cobalt oxide or the like. The chemistry and procedure for preparation of these varistor materials are well known to the art (see for example the aforesaid Schlicke patent) and do not constitute a part of the present invention. The electrical properties of such varistor materials which exhibit minimal resistance in the presence of high voltages, such as overloads, and large resistance at other times to thereby minimize standby current drain is described and illustrated in U.S. Pat. Nos. 3,710,058, 3,710,061 and 3,710,187 and also in the publication "GE-MOV Varistors, Voltage Transient Suppressors" by General Electric Company, December, 1971.

The circuit means 24 in the present embodiment comprises a cylindrical capacitor element which is constructed in substantially the same way as the surge protection element 22 excepting that the sleeve material 24*a* constitutes a barium titanate or other material having a like capacitance characteristic. The electrodes 24*b* and 24*c* may be composed of any of several well known conductive materials deposited on the internal and external surfaces of the sleeve and respective opposite end faces thereof as previously explained in connection with the surge protection means 22. The capacitor element 24 is coaxially disposed over the central rod 12 and is oriented such that the external electrode 24*c* disposed on one end face of the element 24 is in abutting relation to the conductive rubber grommet 20. Those skilled in the art will recognize that consistent with the present invention, the capacitor element 24 may vary in geometry and in particular element composition. The illustrated element 24 is a monolithic capacitor, but it will be understood that a concentric layering of capactive sleeves and electrodes may be employed to form a multi-layer capacitor thereby to attain an increased capacitance, as is understood in the art. In this manner, various capacitance value circuit elements as well as different types of circuit elements may be substituted for the circuit element 24 as a modular building block component of the overall filter contact 10 without requiring modification of the other components of the contact.

Figure 2:
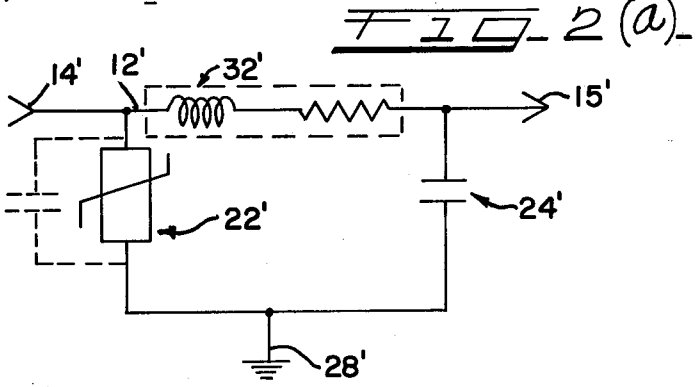
FIG. 2 is a sectional view similar to that of FIG. 1 illustrating an alternative preferred embodiment of the present invention which provides both surge voltage protection and pi filter characteristic.
Figure 1:
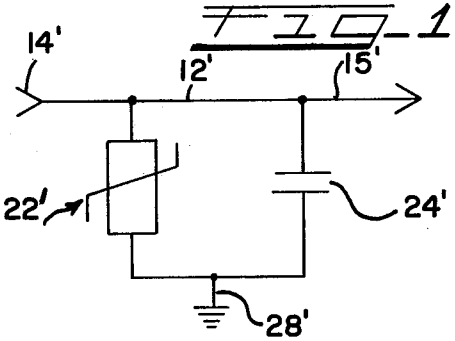
Figure 2:
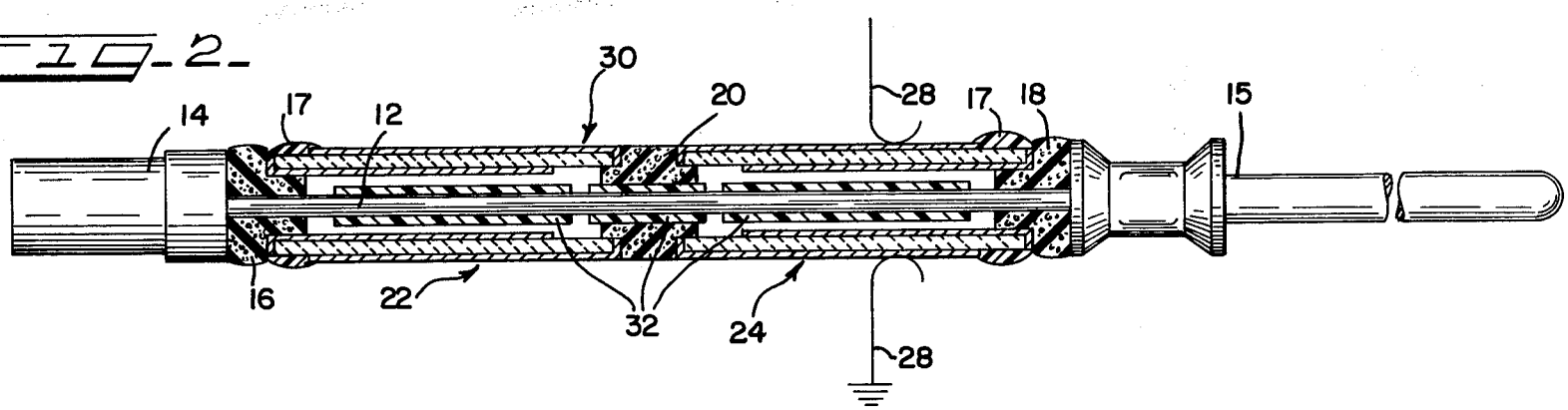
Figure 3:
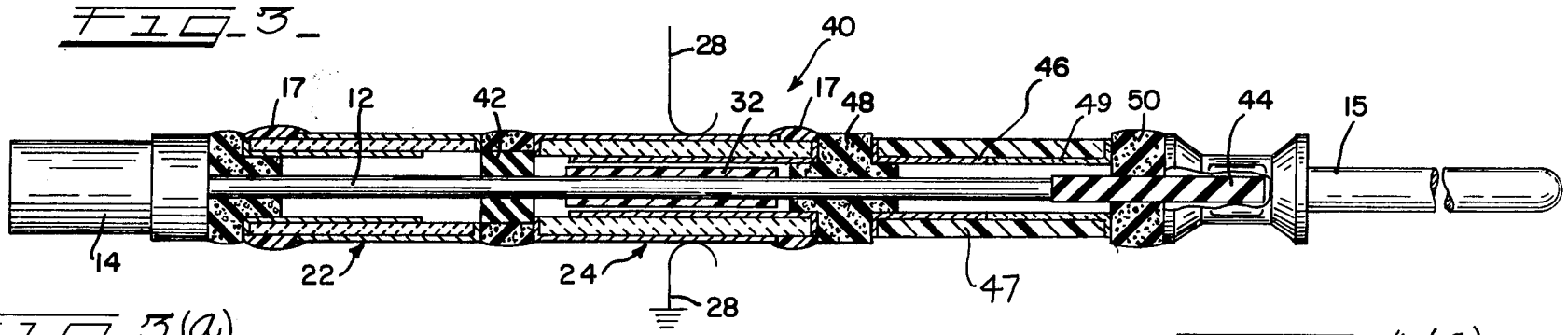
FIG. 3 is a sectional view again similar to FIG. 1 but illustrating yet another preferred embodiment of the electrical contact of the invention which provides a series current limiting resistance in addition to the circuit components of the FIG. 2 embodiment.

In accordance with a feature of the present invention, the individual modular components such as 22, 24 are cascaded in tandem in the contact 10 by use of the resilient conductive means 20 which serves to provide electrical continuity between the outer electrodes 22*c* and 24*c* of the components 22, 24 respectively. Short-circuiting of the outer electrodes to the central rod 12 through conductive grommet 20 is obviated by use of one of sevaral alternative means for effecting an electrically insulative barrier between the internal bore of the grommet 20 and the rod 12. First, a polymeric dielectric material, such as epoxy or enamel 26, may be disposed as an insulative coating layer or separate sleeve element over that portion of the central rod 12 extending through the conductive grommet 20. It is preferred that the insulative coating or sleeve 26 extend a substantial distance beyond the ends of the grommet 20 as shown in FIG. 1 in order to provide reasonable tolerance against inadvertent short-circuiting of the contact 10. A second alternative is to utilize an inductive circuit element that also possesses a dielectric feature; such an arrangement is depicted in FIG. 2 as will presently be explained. A third alternative shown in FIG. 3 is to use a composite grommet which is conductive along its outer length but insulating in its inner portion thereby to electrically isolate the central rod from the outer electrode element. Regardless, however, of the particular alternative selected, it is important that the intermediate conductive grommet 20 be insulated from the central rod 12 and that all three of the conductive grommets 16, 18 and 20 be maintained under a resilient compression to assure that reliable electrical paths to ground are formed for EMI.

The connector structure into which the filter contact 10 is disposed is not illustrated herein since it forms no part of the present invention and since such is well known to those of ordinary skill in the art. However, it will be recognized that the resilient bushings 16, 18 and 20 provide a substantial measure of protection for the fragile ceramic barium titanate and metal oxide materials during installation in the connector in engagement with the grounding tines 28 and thereafter upon exposure of the contact to shock vibration or other extraneous mechanical forces. The tine elements 28 are connected to ground as schematically shown in the drawing; it will be understood that the ground connection may be achieved by various conventional means other than the tines 28.

Referring now to FIG. 1*a*, there is shown an electrical circuit equivalent of the contact assembly of FIG. 1. In FIG. 1*a*, as with the other electrical circuit equivalent drawings shown herein, the circuit equivalent is designated by the same reference numeral as the structural component excepting for the use of prime designations in the circuit drawing. As seen in FIG. 1*a*, the signal path for electrical signals within the desired frequency range is provided from the input 14' through the central conductor 12' to the output pin 15'. Unwanted high frequency signals are shunted to ground through a ground plate 28' by the filter capacitor 24'. High voltage surges in excess, for example, of 100 volts or more which would likely cause damage to either or both the filter capacitor and electrical equipment connected to the output pin 15' are shunted to ground independently of frequency, by the metal oxide varistor 22'. The filter contact of FIG. 1 thus provides the effective filtering of electrical signals above a predetermined frequency minimum and electrical overload protection above a predetermined voltage maximum by use of individual building block components joined within a single contact unit. The individual building block components 22, 24 may be assembled in any ordered relation, i.e., the capacitor 24' electrically in advance of the varistor 22', and individually selected from an inventory stock to match particular circuit design parameters. The advantage and facility of such a building block concept for use particularly in feedthrough electrical connectors is further appreciated by reference to the other embodiments herein illustrated.

Referring now to FIG. 2, there is illustrated a further preferred embodiment of the invention which is shown generally by the reference numeral 30. The filter contact 30 may be identical to the contact 10 of FIG. 1 excepting insofar as hereinafter described and for convenience like reference numerals have been used in FIG. 2 to identify those components that are the same as those in FIG. 1. A like convention is used in the succeeding Figures of the application.

In FIG. 2, a series inductive reactance and RF resistance component is added to the filter contact electrical circuit characteristic by disposing one or more ferrite sleeves on the central metal rod 12. The inductivfe reactance and RF resistance indicated generally by the reference numeral 32 is divided into three separate sleeve segments along the rod 12 with the central segment disposed to lie beneath the central conductive grommet 20. The two end segments of the ferrite sleeve 32 are disposed within the central portions of the respective circuit components 22, 24. The end segments of the ferrite sleeve 32 are shown, for clarity of illustration, in spaced relation to the end grommets 16, 18, although such spacing is not essential in practice. The ferrite segments 32 provide a distributed inductive reactance and RF resistance along the length of the rod 12. At least the central segment 32 is provided with an outer cladding that forms in addition a dielectric surface barrier insulating the conductive grommet 20 from the central rod 12. Thus, at least the central segment 32 of the ferrite sleeve performs a dual function as a series RF impedance and a dielectric electrically insulative barrier.

Although the metal oxide varistor component 22 of the filter contact 30 bears the same reference numeral as its counterpart in FIG. 1, the physical chemistry of this component may be selected so as to provide a substantial measure of capacitive reactance, i.e., a low pass filter characteristic, to signals within an acceptable voltage range while performing still the surge protection function in response to EMI signals above a predetermined voltage maximum. The concurrent use of a metal oxide varistor as a low pass filter and a surge protection device is disclosed in the aforementioned Schlicke patent.

Referring now to FIG. 2*a*, the electrical circuit equivalent of the filter contact 30 of FIG. 2 is illustrated. This circuit schematic is similar to FIG. 1*a* excepting that the ferrite sleeve 32' provides a series inductance and RF resistance along the central rod 12' between the input and output pins 14' and 15', respectively. Also, the effective low pass filter capacitance provided by the MOV 22 is indicated by the capacitor symbol drawn in shunt and in phantom outline to the MOV symbol 22'. The embodiment of FIG. 2 provides all of the advantageous structural features of the embodiment of FIG. 1 and provides a pi filter performance which is in part achieved by the dual functioning of the MOV element 22 as both a low pass filter capacitor and a surge protection device.

A filter contact 40 embodying further features of the present invention is depicted in FIG. 3. Again, the components which correspond to those of FIGS. 1 and 2 and which bear like reference numerals will not be described in detail. Additionally, although in FIG. 3 only a single ferrite element 32 is illustrated beneath the annular component 24, it will be understood that effective utilization of available space suggests that similar ferrite sleeves may be disposed along the length of rod 12 if further inductive reactance and RF resistance is desired.

In FIG. 3, a composite rubber grommet 42 is disposed intermediate components 22, 24 to provide electrical continuity between the circumferential electrodes of each component and to ground and further to concurrently insulate these electrodes from the conductive rod 12. The composite grommet 42 includes an outer annular portion of a flexible, conductive rubber-like material and an annular internal portion of a similar, but electrically non-conductive material.

A non-conductive sleeve member 44 is disposed over the right-most end portion of the central rod 12 in FIG. 3 so as to form an electrically insulative barrier between the rod 12 and the contact pin 15. An electrical path from rod 12 to the pin end 15 of the contact is effected through a series resistor component 46 and a fuse component 49 both formed as contiguous tandem cylindrical surface layers on the interior surface of the dielectric sleeve 47 that is disposed between conductive grommets 48, 50. The cylindrical resistor 46 and the cylindrical fuse 49 form an electrically continuous path at their abutting ends. The non-contiguous ends of resistor 46 and fuse 49 are mechanically coupled to the adjacent components, namely, the capacitor element 24 and the end pin 15 in a resilient manner by conductive resilient grommets 48, 50, respectively, which serve also to provide electrical continuity with the resistor 46 and the fuse 49. The resistive sleeve member 46 and fuse 49 may be constructed of any of a variety of materials familiar to those skilled in the art and the construction of these elements per se are not part of the present invention.

The electrical circuit equivalent of the contact 40 as shown in FIG. 3*a* is similar to that of FIG. 2 excepting that a series DC current limiting resistance 46' and a fuse element 49' are coupled electrically in series between the non-grounded output terminal of capacitor 24' and the contact pin 15'. Accordingly, the construction of FIG. 3 provides not only a pi filter network for filtering of undesired EMI, but in addition provides both current limiting and voltage surge protection. Again, any of a wide variation of characteristics may be achieved by appropriate preselection of the building block components of the contact 40.

An alternative current limiting feature is provided without insertion of a continuous DC resistance loss if the element 46 is omitted and the fusible cylindrical electrode cladding 49 is extended for the full length of the dielectric cylinder 47. The fusible cladding 49 is preferably disposed on the internal circumferential surface of the dielectric sleeve 47 as shown so that the flash associated with the fusing action will not pose a fire or other damage hazard for adjacent filter contacts or other system components. The fusible cladding functions in the manner of a conventional fuse device to melt and interrupt the circuit path at current levels exceeding a predetermined value. This feature may be incorporated in lieu of the resistor 46 as described, or in series with the resistance 46 so as to provide circuit interruptions only in the presence of an extraordinary current surge as may be caused for example by lightning. This added feature provides virtual failsafe protection to the electrical system.

Figure 4:
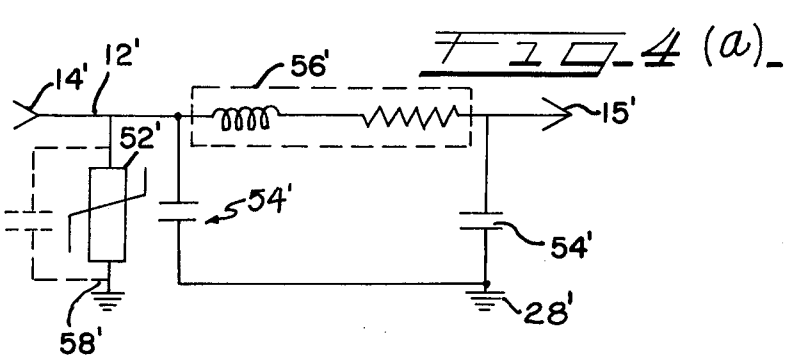
FIG. 4 is a sectional view likewise similar to FIG. 1 of another preferred embodiment of the contact of the present invention.
Figure 3:
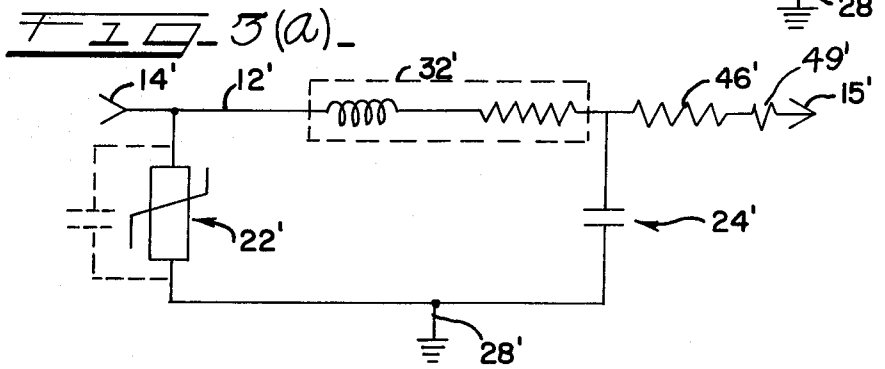
Figure 4:
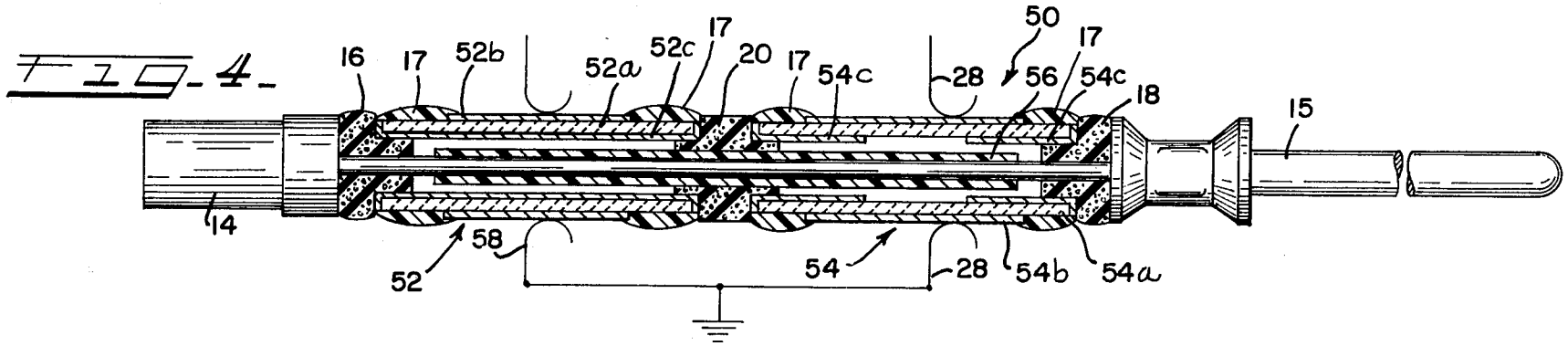

Referring now to FIG. 4, the embodiment there shown is basically similar to that of FIG. 2 excepting only that variations have been made in the electrode configuration of the tandem surge protection device and capacitor elements herein represented by the numerals 52 and 54. The purpose of the different electrode configuration is to provide for a pair of independent ground plane connections from the outer electrodes of the two components, as will presently be seen. The FIG. 4 embodiment also differs from that of FIG. 1 in providing a reactance component 56 which extends approximately the full length of the capacitor sleeve 54.

The surge protection element 52 includes a varistor sleeve 52*a* which may be composed of the same material previously described. However, the electrodes deposited on the sleeve 52*a* are markedly different in geometry from those illustrated in the prior Figures. Specifically, the electrode 52*b* deposited on the outer circumference of the sleeve 52*a* is in the form of a circumferential band centrally disposed between the extremities of the sleeve 52*a*. The internal electrode 52*c*, by contrast, extends the full length of the internal bore of the sleeve 52*a* and also onto both end faces of the sleeve.

The electrode arrangement for the filter capacitor 54 differs in one significant respect from that of the element 52 as well as the electrode arrangements earlier described in connection with the other embodiments. Specifically, while the outer or ground electrode 54*b* may be a circumferential band centrally disposed between the ends of the sleeve 54*a*, the internal electrode configuration is discontinuous in a central portion. More particularly, the internal electrode 54*c* of capacitor 54 comprises two cylindrical segments deposited as circumferential bands on the internal surface of the sleeve 54*a* with the electrode portion of each segment extending onto a respective end face of the sleeve 54*a*.

The consequence of the electrode structure described in FIG. 4 is that the ground electrodes 52*b* and 54*b* are electrically isolated from one another and must be brought to ground schematically in the drawing. The separate ground paths for the surge protection and capacitor elements in addition to lowering ground impedance and increasing current carrying capacity to ground also obviate the need to electrically insulate the conductive grommet 20 from the central rod 12. In the present arrangement, the conductive grommet 20 forms part of the normal electrical circuit signal path as opposed to being a part of the electrical circuit path to ground, as in the prior embodiments.

The electrical circuit equivalent of the contact 50 is shown in FIG. 4*a*. Basicaly, the circuit is the same as that of FIG. 2*a* excepting only that the two shunt circuit elements, namely, the varistor and capacitor elements are brought to ground in FIG. 4*a* through two separate ground connection contacts 58' and 28' as opposed to the single ground contact 28' of FIG. 2*a*. Moreover, the capacitor 54' comprises two separate components coupled to ground 28' from opposite sides of the reactance component 56' thereby to form a pi filter network on the output side of the varistor 52'.

It will be recognized that various combinations and permutations of the various features of the several embodiments above-described may be simply incorporated into a particular connector configuration to arrive at an overall custom designed connector configuration accommodating a very broad range of performance characteristics.

While particular embodiments of the present invention have been shown and described, it is apparent that various changes and modifications may be made, and it is therefore intended in the following claims to cover all such modifications and changes as may fall within the true spirit and scope of the invention.

I claim:

1. An electrical filter contact, comprising:

conductor means having input and output portions for connection to respective electrical signal carrying elements and having a central portion comprising at least a part of an electrical path between said input and output portions;

electrical circuit means disposed between said input and output portions and generally along said central portion of said conductor means including a ground electrode disposed in spaced relation to said conductor means for co-acting with electrical signals applied to said input portion of said conductor means to provide a predetermined impedance characteristic;

electrical overload protection means disposed in tandem to said circuit means along said central portion adjacent said input portion and comprising a ground electrode disposed in spaced relation to said conductor means and including varistor material disposed intermediate said central portion and said ground electrode for shunting to said ground electrode electrical voltages in excess of a predetermined value; and resilient conductive means including a first flexible, conductive grommet member interposed intermediate said circuit means and said surge protection means for effecting a low resistance electrical path and a flexible mechanical connection therebetween.

2. The electrical contact of claim 1 in which said electrical circuit means comprises a signal electrode coupled to said output portion and a barium titanate capacitive material interposed between said signal electrode and said circuit means ground electrode.

3. The electrical contact of claim 1 and further including insulative means comprising insulative material disposed intermediate said central portion of said conductor means and said first grommet member for insulating said resilient conductive means from said central portion and for effecting a mechanically flexible, electrical bridge connection between said ground electrodes.

4. The electrical contact of claim 3 in which said resilient conductive means further includes second and third flexible conductive grommet members disposed intermediate, respectively, said input portion and said overload protection means and said output portion and said circuit means.

5. The electrical contact of claim 3 in which said electrical circuit means comprises a resistive component including a non-conductive element disposed between said output and central portions of said conductor means and a resistive element disposed about said non-conductive element for establishing an electrically conductive, predetermined resistance path between said output and said central portions of said conductor means.

6. The electrical contact of claim 5 in which said non-conductive element comprises an electrically insulative coating on said output portion of said conductor means.

7. The electrical contact of claim 3 in which said insulative means comprises insulative material integral with said first grommet member.

8. The electrical contact of claim 3 in which said insulative means comprises a coating applied to said central portion of said conductor means.

9. The electrical contact of claim 8 in which said insulative means comprises a ferrite material for concurrently insulating said central portion of said conductor means from said first conductive grommet and for providing a series RF impedance component for said circuit means.

10. The electrical contact of claim 9 in which said central portion of said conductor means comprises an elongated metal rod and in which said overload protection means comprises a signal electrode having an end portion in electrical contact with said second conductive grommet and an elongated cylindrical electrode portion having an internal surface adjacent said ferrite material, said varistor material being disposed between an outer surface of said cylindrical signal electrode and internal surface of said surge protection means ground electrode.

11. The electrical contact of claim 10 in which said electrical circuit means comprises a material having a high electrical capacitance, a signal electrode having an end portion in electrical contact with said third conductive grommet, an elongated cylindrical electrode portion having an internal surface adjacent said ferrite material and with said capacitance material being disposed between an outer surface of said cylindrical signal electrode and internal surface of said circuit means ground electrode.

12. An electrical contact comprising:

conductive means having input and output portions for connection to respective electrical signal carrying elements and having a central portion comprising at least a portion of an electrical circuit path between said input and output portions;

electrical overload protection means disposed along said central portion and including a ground electrode disposed in spaced relation to said central conductor means and varistor material disposed intermediate said central portion and said ground electrode for shunting to said ground electrode transient electrical surges in excess of a predetermined value; and resilient conductive means including a first flexible, conductive grommet member interposed between one end of said surge protection means and said first end portion of said conductive means for effecting a low resistance electrical path and a flexible mechanical connection therebetween.

13. The electrical contact of claim 12 in which said electrical overload protection means comprises a cylindrical sleeve of varistor material having opposed end portions and having a signal electrode formed on the internal surface of said sleeve with said signal electrode integrally extending onto only one face of said sleeve end portion, said one sleeve end portion being positioned in firm engagement with said first conductive grommet.

14. The electrical contact of claim 13 in which said resilient conductive means includes a second, flexible conductive grommet member interposed between the remaining face of said sleeve member and said output portion of said conductor means.

15. The electrical contact of claim 14 and further including electrical circuit means comprising a series resistance component having a non-conductive element disposed intermediate said central and output portions of said conductor means and a resistive element disposed for electrically interconnecting said central and output portions of said conductor means.

16. The electrical contact of claim 15 in which said resilient conductive means includes a further flexible, conductive grommet member interposed between said series resistance component and said output portion of said conductor means.

17. The electrical contact of claim 12 and further including insulative means having an insulative layer of ferrite material on a predetermined portion of the length of said central portion.

18. An electrical contact, comprising:

conductor means having input and output portions for connection to respective signal carrying elements and having a central portion comprising at least a portion of an electrical circuit path between said input and output portions;

electrical circuit element means comprising a plurality of circuit components disposed in tandem generally along said central portion and intermediate said input and output portions for substantially preventing transmission of predetermined electromagnetic interference signals from said input portion to said output portion; and resilient conductive means comprising flexible conductive grommet members disposed between each of said plurality of tandem circuit components and adjacent said input and output portions of said conductor means, said input and output portions of said conductor means retaining said grommet members in resilient axial compression.

19. The electrical contact of claim 18 in which said electrical circuit element means includes a surge protection element and a low pass filter element.

20. The electrical contact of claim 18 in which said electrical circuit means includes a series fuse element for opening the electrical circuit between said input and said output portions of said conductor means in response to an electrical current exceeding a predetermined value.

* * * * *